US006143235A

United States Patent [19]

Birkert

[11] Patent Number: 6,143,235

[45] Date of Patent: Nov. 7, 2000

[54] METHOD FOR PRODUCING SECONDARY MOLD ELEMENTS

[75] Inventor: Arndt Birkert, Bretzfeld, Germany

[73] Assignee: DaimlerChrysler AG, Stuttgart, Germany

[21] Appl. No.: 09/127,830

[22] Filed: Aug. 3, 1998

[30] Foreign Application Priority Data

Aug. 2, 1997 [DE] Germany ..... 197 33 474

[51] Int. Cl.[7] ..... B29C 49/02; B29C 49/76

[52] U.S. Cl. ..... 264/529; 264/534

[58] Field of Search ..... 264/529, 531, 264/534, 523; 425/112, 525, 530, 532

[56] References Cited

U.S. PATENT DOCUMENTS

| | | | |
|---|---|---|---|
| 3,004,285 | 10/1961 | Hagen | 264/534 |
| 4,510,116 | 4/1985 | Peters et al. | 264/529 |
| 4,928,509 | 5/1990 | Nakamura . | |
| 4,938,680 | 7/1990 | Guarriello et al. | 425/522 |
| 5,202,078 | 4/1993 | Moore | 264/527 |
| 5,469,612 | 11/1995 | Collette et al. | 264/534 |
| 5,750,067 | 5/1998 | Hellbrugge | 425/525 |
| 5,932,166 | 8/1999 | Bousselin et al. | 264/534 |

FOREIGN PATENT DOCUMENTS 94 07 812 9/1994 Germany .

195 08 632 9/1996 Germany .

*Primary Examiner*—Angela Ortiz

*Attorney, Agent, or Firm*—Evenson, McKeown, Edwards & Lenahan, P.L.L.C.

[57] ABSTRACT

A method and a device for manufacturing secondary mold elements such as necks, protrusions, raised elongate flat locations and the like on elongate, circumferentially closed hollow shapes by means of internal-high-pressure shaping. The secondary mold element is shaped locally by widening of the hollow shape using a high-pressure fluid therein, and is supported under control during the shaping process by a counter plunger that expands outward with increasing shaping. In order to expand the method limits during the manufacture of a secondary mold element for an increase in its height in a safe and simple manner, the hollow section is upset inward by the counter plunger at the point where the secondary mold element is to be produced, whereupon the hollow shape material in the vicinity of the inward upsetting point is pressed circumferentially and endwise by the high-pressure fluid and the plunger. After the inward upsetting process, the hollow section is upset outward under internal high pressure by retracting the plunger that constantly abuts the hollow section, and the secondary mold element is formed.

6 Claims, 2 Drawing Sheets

METHOD FOR PRODUCING SECONDARY MOLD ELEMENTS

BACKGROUND AND SUMMARY OF THE INVENTION

This application claims the priority of German patent 197 33 474.1-14, filed Aug. 2, 1997, the disclosure of which is expressly incorporated by reference herein.

The invention relates to a method for manufacturing secondary mold elements such as necks, protrusions, raised elongate flat areas, and the like on elongate, circumferentially closed hollow shapes by means of internal high-pressure forming, and an apparatus for performing such a method.

A method and an apparatus of the type generally described above are known from German patent document DE 94 07 812.2 U1. In this document, a secondary mold element in the form of a hollow cylindrical neck is produced on a tubular hollow shape, with the hollow shape being placed in a bipartite internal-high-pressure mold and, after the tool is closed, being subjected internally to a high-pressure fluid generated by an externally located high-pressure fluid generating system. The cavity in the mold that matches the contour of the hollow shape blank shapewise has a branch into which the hollow shape material is forced under the influence of the internal high pressure together with an axial upsetting movement (i.e., a pressing-in movement) that follows the hollow shape material, by endwise impact on the hollow shape by two pressure pistons displaced axially opposite one another back and forth in the cavity, forming a neck. In order to prevent premature bursting of the hollow shape material in the shaping area of the neck, a counter plunger is displaceably guided in the branch, said plunger abutting the hollow shape during the entire shaping process and impacting the hollow shape with a force that is directed opposite the force of the expansively acting internal high pressure, with the counter plunger deflecting outward under control so that the neck is not formed suddenly but under control. At the same time, the counter plunger ensures that the hollow shape material does not thin out excessively in the cap area of the neck so that shaping can proceed safely up to a certain neck height. This neck height depends on the thinning of the material of the hollow shape in the mouth area of the branch to the cavity, since stretching takes place at this point, even with a large radius for the bending edge at this location, and also depends upon the accumulation of material in the abovementioned cap area. The method described, for a safe manufacturing procedure, applies exclusively to short hollow shapes since in the case of long hollow shapes, in the range from approximately one meter and more, the frictional forces between the wall of the cavity and the hollow shape during the axial pushing indicated become so great that this is no longer possible without undesired folding of the shape and/or shearing cracks in the shape. In long hollow shapes, therefore, necks can only be produced by a simple expansion process, but with only the material present in advance in the neck area being available and this therefore can only be obtained from the wall thickness of the hollow shape. A clearly visible elongate neck is therefore not possible.

A goal of the invention is to improve on a method and a device for forming secondary mold elements such that expansion of the method limits during the manufacture of a secondary mold element with respect to an increase in its height can be achieved in a safe and simple manner.

This and other goals have been achieved according to the invention by providing a method for producing secondary mold elements as necks, protrusions, raised elongate flat locations, and the like on elongate, circumferentially closed hollow sections by means of internal high-pressure shaping, with the secondary mold element being shaped locally by the expansion of the hollow section using a high-pressure fluid therein, and being supported under control during the shaping process by a counter plunger that yields outward with increasing shaping, characterized in that hollow section is upset (i.e., pressed in) at the location of the secondary mold element to be produced by counter plunger, whereupon the hollow shaped material in area of inward upsetting is pressed circumferentially and endwise by the high-pressure fluid at plunger and that after the upsetting process, by retraction of plunger which constantly abuts hollow section during the entire shaping process, in conjunction with the internal high pressure, hollow section is externally upset and secondary mold element is formed.

This and other goals have been achieved according to the invention by providing an apparatus for producing secondary mold elements such as necks, protrusions, raised elongate flat locations and the like on elongate, circumferentially closed hollow sections, with an internal high pressure mold divided into an upper tool and a lower tool, whose cavity that receives a hollow section has at least one branch in which a counter plunger provided with a controlled drive is displaceably guided, and with a high-pressure fluid system that is connectable fluidically with internal high pressure mold, characterized in that counter plunger is guided in a passageway of a stop body that is rigidly located in the branch and abuts branch wall closely in such fashion that counter plunger can be displaced into cavity for inward upsetting of hollow profile located with limited play in cavity of mold, and can be sunk under the influence of internal high pressure into stop body for shaping secondary mold element.

According to the invention, as a result of the internal high-pressure-produced contact between the hollow shape and the counter plunger in the upsetting (i.e., pressing-in) position of the counter plunger, hollow shape material is displaced into the branch area and the maximum material stress takes place in the fibers of the material that will subsequently be subjected to less stress. As a result, firstly, in the shaping of the secondary mold element, the hollow shape is relieved of a load in the mouth area of the branch, since at that point, as a result of the material accumulated in the branch area in advance, following the initial projection of the hollow shape by pulling back the counter plunger, it is only considerably later that the conventional widening, and hence the material thinning, occurs in the wall of the hollow section. At the same time, because of the increased accumulation of material in the branch area, the cap area of the secondary mold element also grows much thinner later, so that with the same state of dilution of the hollow section material at the critical points in the secondary mold element, the mouth area of the branch and the cap area, by comparison with conventional methods for producing secondary mold elements, greater heights for the secondary mold element during its shaping can be achieved without cracks occurring at these points and hence without the hollow shape bursting in the branch. Consequently, the method limits in the manufacture of a secondary mold element regarding an increase in its height are increased and the safety of the shaping process is ensured. In this way, the reject rate in manufacturing hollow shapes with secondary mold elements can also be significantly reduced.

The formation of the increased height of the secondary mold element is made possible in simple fashion since the counter plunger, as a result of constant supporting contact with the hollow shape for controlled shaping of the secondary mold element, is present in any event, it is used for internal upsetting and hence for accumulating material. The secondary mold element is shaped by expanding the hollow shape using a high-pressure fluid generated therein, whereby the counter plunger, yielding outward with increasing shaping, supports the hollow shape in the shaping area during the shaping process under control.

Other objects, advantages and novel features of the present invention will become apparent from the following detailed description of the invention when considered in conjunction with the accompanying drawings.

DETAILED DESCRIPTION OF THE DRAWINGS

Figure 1A:
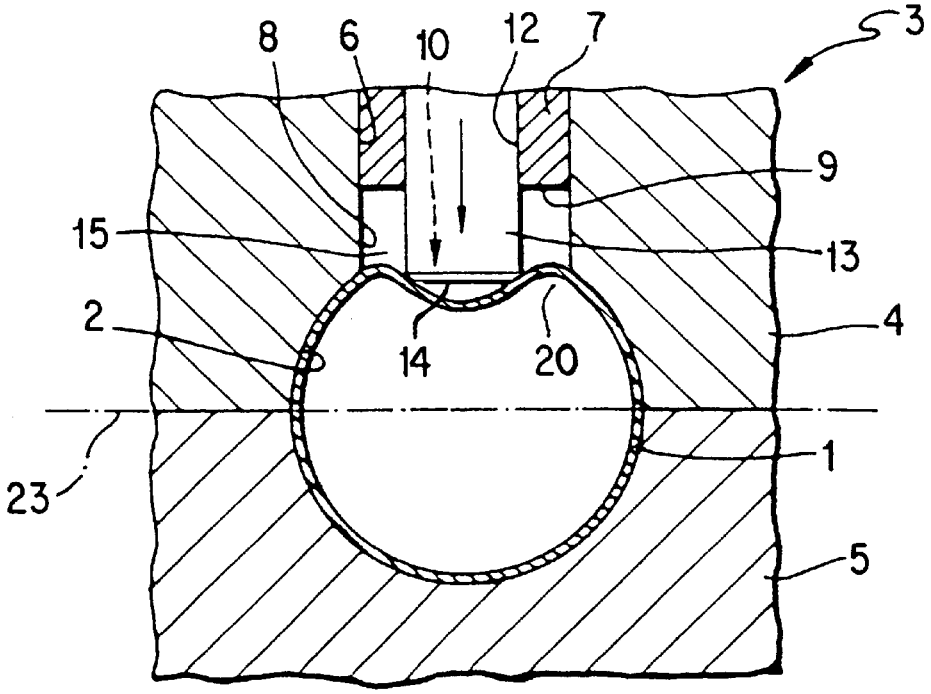
FIGS. 1*a–d* show the shaping process according to a preferred embodiment of the invention for a secondary mold element on a hollow shape in a cross-sectional view.

FIGS. 1*a–d* show a hollow section 1 placed in the cavity of an internal-high-pressure mold 3 of the device according to the invention. Mold 3 is divided into an upper tool 4 and a lower tool 5, with parting plane 23 between the two tool parts 4 and 5 corresponding to the horizontal central plane of hollow shape 1. In upper tool 4, a recess 6 is formed that is directed radially toward inserted hollow shape 11 said recess terminating in cavity 2 and defining a branch of cavity 2. The cross section of the branch can be circular, oval, rectangular, or polygonal, symmetrical or asymmetrical. The cavity 2 of internal-high-pressure mold 3 can also be connected fluidically with a high-pressure-fluid generating system.

In recess 6, a stop body 7 is located rigidly, i.e. immovably, so that it can be pressed into recess 6 or be supported permanently at the back. The body 7 conforms to the contours of branch wall 8 and has its end 9 facing the cavity set back into recess 6 by a certain amount from mouth area 10 of the branch to cavity 2, which defines the height of the secondary mold element 11 shaped later. The stop body 7 limits the expanding movement of the hollow shape material during shaping by acting as a stop. Stop body 7 can also be an integral part of upper tool 4.

Stop body 7 has a central passageway 12 in which a counter plunger 13 is displaceably guided, said plunger being provided at the rear with a mechanical or hydraulic drive. Counter plunger 13 has approximately the same cross-sectional shape as stop body 7 and has a circumferential bevel edgewise on its face 14 facing hollow section 1. The bevel produces, in an advantageous manner, a reliable application of the hollow shape material against counter plunger 13 in order to prevent notching of a sharp edge of plunger 13 into hollow shape material which tends to cause cracking during shaping by using internal high pressure. Instead of being beveled, end 14 can also be made rounded at the edges. Another contemplated feature is that the cross section of counter plunger 13 fills recess 6 lengthwise.

According to FIG. 1*a*, in closed mold 3, counter plunger 13 is advanced toward hollow shape 1, located with a small amount of play in cavity 2, and upsets or engages it with its end 14. As long as counter plunger 13 is extended out of contact body 7, it, together with branch wall 8 and as a result of its distance from it, forms an annular groove whose width, with suitable dimensioning as in the illustrated embodiment, allows an annular chamber 16 to be made from it.

Figure 1B:
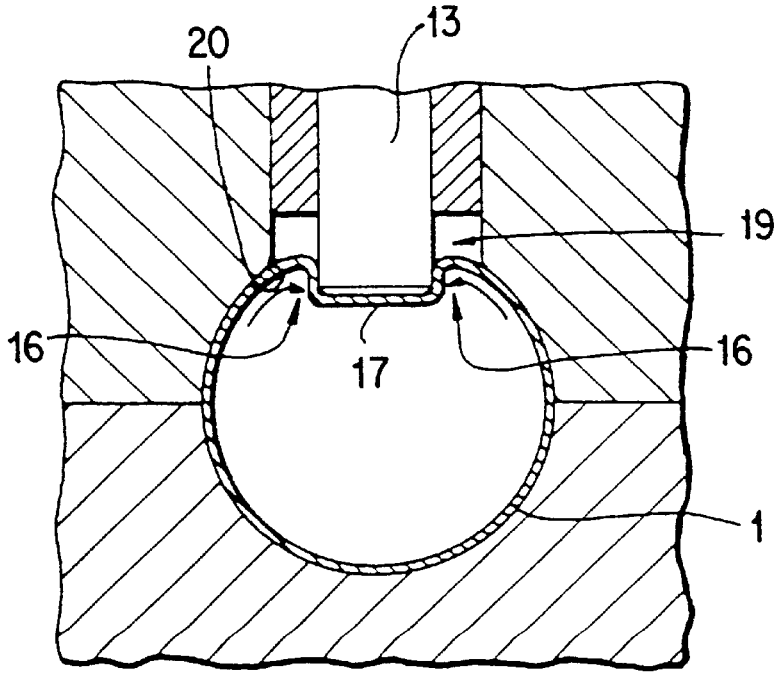
Figure 1C:
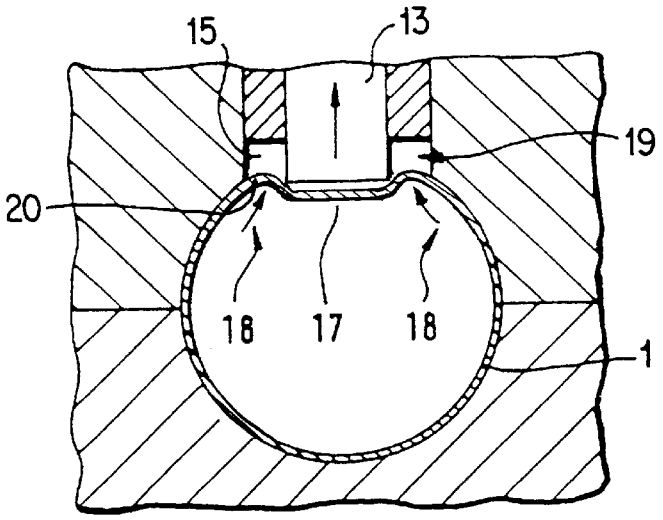

In the method according to the invention, if hollow section 1, during the upsetting process or, as shown in FIG. 1*b*, after the upsetting process is complete, is under high internal pressure, the hollow-shape material flows not only out of area 16 of hollow shape 1 that directly surrounds upsetting point 17 but also out of the area 18 of cavity 2 that adjoins the branch to the upsetting point 17 and abuts counter plunger 13 circumferentially and endwise. As a result, hollow shape material is compressed at mouth area 10 of the branch, so that material of hollow section 1 is accumulated for the shaping of secondary mold element 11, and the shaping height can be safely increased as a result.

By the formation of an annular space 15 that is elongate and relatively wide in cross section, the hollow shape material, simultaneously with the abovementioned application of counter plunger 13 which is in the upsetting position, is pushed in past the plunger and out of areas 16 and 18 into annular space 15 so that hollow-shape material, even before the actual shaping of secondary mold element 11, is present in shaping area 19 for shaping, which is equivalent to an additional supply of hollow-shape material and a further safe ability to increase the molding height.

As a result of the pull of counter plunger 13 caused by upsetting in hollow shape 1, the flow of hollow shape material is directed away from bending edge 20 between the branch and cavity 2 toward counter plunger 13, so that thinning of the hollow shape material as a result of the stretching caused by the method during widening at bending edge 20 because of the relief of the load on the edge area is avoided. In order to reduce stretching as well during the shaping of secondary mold element 11, bending edge 20 is made with a large radius so that cavity 2 makes a gentle transition to the branch.

It is also contemplated to conduct the upsetting process without internal high pressure. In this connection, hollow section 1 is bent inward over a much wider area, as viewed from bending edge 20, since the internal high pressure counteracting the inward bending is absent. As a result, during subsequent build-up of internal high pressure from circumferential areas of hollow shape 1 that are located much deeper relative to shaping area 19, material can be supplied to the branch since hollow section 1 extends toward shaping area 19 in addition to the ordinary contact of hollow section 1 with cavity 2. As a result, a supply of additional hollow section material in the direction of shaping area 19 and hence an additional safe increase in the shaping height of the secondary mold element is achieved.

After the upsetting of hollow section 1 and the application of the hollow shape material laterally against counter plunger 13 under internal high pressure, counter plunger 13 is withdrawn (FIG. 1*c*) while maintaining this pressure. The upset point 17 is continuously upset outward once again by the internal high pressure, with further hollow section material being forced into annular space 15 that still exists.

Following the outward upsetting process in which counter plunger 13 is constantly in contact with hollow section 1, secondary mold element 11 is shaped from hollow section 1. This can be accomplished by simple widening which can be used especially in long hollow shapes in which no axial feed by means of pressure plungers engaging both ends of the hollow section is safely possible because of the frictional relationships. Feed during expansion with relatively short hollow sections on the other hand is readily possible, so that material can be fed into shaping area 19 from the hollow shape ends, which also contributes to increasing the shaping height of secondary mold element 11. Counter plunger 13 acts as a conventional counter stop that supports hollow section 1 in the shaping area during the shaping process, so that the shaping of secondary mold element 11 proceeds under control.

Figure 1D:
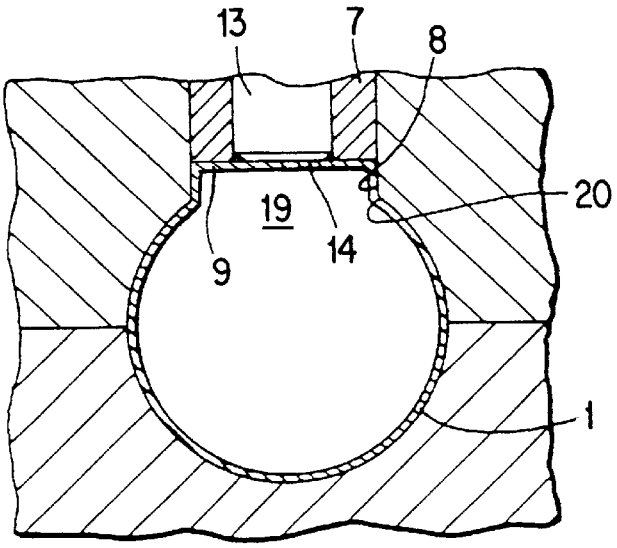

In the final phase of the shaping process, the hollow section material abuts stop body 7 and branch wall 8 at least in coarse approximation with an accurate fit to the contours, with counter plunger 13 being sunk into stop body 7, so that their two ends 14 and 9 fit flush against one another (FIG. 1*d*).

Figure 2:
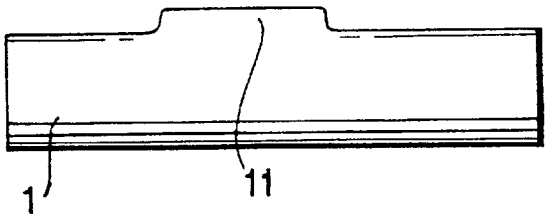
FIG. 2 shows the hollow shape shaped according to the invention in a side view.

It is also advantageous for end 14 of counter plunger 13, end 9 of stop body 7, and branch wall 8 to have the exact end shape of secondary mold element 11. Then, to complete the shaping process with an internal high pressure that is elevated relative to the shaping process (i.e., calibration) secondary mold element 11 is then given its final shape with accurate contours as shown in FIG. 2, in the form of a raised, elongate, flat location.

The movement of the counter plunger 13 depends upon various parameters, including the characteristics of the material of the hollow section 1, the dimensions and configuration of the mold 3, the pressure, and the size and configuration of the counter plunger 13 itself. If the upsetting (pressed-in) position is achieved under internal high pressure, the hollow section material is already in the flowable condition and can from the start, that is, from the beginning of the action by the counter plunger 13 onto the hollow section 1, place itself against the counter plunger and flow into the annular space 15. In this case, the dwell duration of the counter plunger 13 in the pressed-in position may be relatively short. In the other case, when the pressing-in of the hollow section 1 takes place only by the mechanical action via the counter plunger 13, in the achieved pressed-in position, an internal high pressure must first be built up. This is naturally a function of the characteristic data, particularly of the pumping capacity of the respective hydraulic high-pressure system. For example, the dwell time could in that case be from 2–3 seconds. The withdrawal velocity, at which the counter plunger 13 is moved back into the position illustrated in FIG. 1*d*, may be, for example, 5 m/sec, which withdrawal movement takes place continuously.

At a preliminary stage in the mold release operation, which takes place at a relatively lower pressure (for example, approximately 1000 bar), the resulting secondary mold element 11 is rounded on its end edges. In this condition, the hollow section material does not rest completely on the branch wall 8 and the stop body 7, but the corner area between the branch wall 8 and the stop body 7 remains recessed. However, in order to precisely copy the contours of the whole tool with the hollow section material and thus produce sharp edges on the secondary mold element 11, the hollow section material must be forced also into the rectangular corner area of the tool. In this subsequent stage, a considerably higher internal high pressure is required (for example, 2,000–3,000 bar) than for the preliminary stage mold release. This final phase of the mold release is called calibration (or shaping to size).

Secondary mold elements 11 can also be designed as necks or protrusions and the like on elongate circumferentially closed hollow sections 1 and can serve as flange or mounting surfaces. In this connection, sheet metal parts and their application to a hollow section can be eliminated, with which this function can likewise be achieved.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for producing a secondary mold element on an elongate, circumferentially closed hollow section while maintaining a shape of the closed hollow section by means of internal high-pressure shaping, with the secondary mold element being shaped locally by an expansion of material of the hollow section using a high-pressure fluid therein, and being supported under control during the shaping process by a counter plunger that yields outward with increasing shaping, comprising:

inserting the counter plunger in a recess of a mold for shaping the secondary mold element while maintaining the shape of the closed hollow section;

inwardly upsetting the hollow section material at the location of the secondary mold element using the counter plunger, whereby the hollow shaped material in an area of the inward upsetting is pressed circumferentially and endwise by the high-pressure fluid at the plunger while maintaining the shape of the closed hollow section; and externally upsetting the hollow section material by retracting the plunger which constantly abuts the hollow section during the entire shaping process, in conjunction with the internal high pressure to form the secondary mold element while maintaining the shape of the closed hollow section.

2. The method of claim 1, wherein the secondary mold element is a neck, a protrusion or a raised elongate flat location.

3. The method of claim 1, wherein the inward upsetting of hollow section takes place under atmosphere pressure in hollow section.

4. The method of claim 1, wherein the inward upsetting of hollow section takes place under internal high pressure in hollow section.

5. The method of claim 1, wherein in the inwardly upset position of the plunger, the hollow shape material is pushed inward by the internal high pressure at the plunger into a shaping area of the secondary mold element.

6. The method of claim 1, wherein after the plunger is retracted, the secondary mold element is calibrated with accurate contours by fluid pressure that is increased relative to the shaping process.

* * * * *